US008789220B2

(12) United States Patent
Flemister

(10) Patent No.: US 8,789,220 B2
(45) Date of Patent: Jul. 29, 2014

(54) POWERED ROCKING BED DEVICE

(76) Inventor: James Flemister, Dallas, TX (US)

( * ) Notice: Subject to any disclaimer, the term of this patent is extended or adjusted under 35 U.S.C. 154(b) by 243 days.

(21) Appl. No.: 13/542,750

(22) Filed: Jul. 6, 2012

(65) Prior Publication Data

US 2013/0007958 A1 Jan. 10, 2013

Related U.S. Application Data

(60) Provisional application No. 61/505,488, filed on Jul. 7, 2011, provisional application No. 61/547,215, filed on Oct. 14, 2011.

(51) Int. Cl.
*A61G 7/008* (2006.01)

(52) U.S. Cl.
USPC ..... 5/108; 5/609; 5/109

(58) Field of Classification Search
USPC ..... 5/607–610, 108–109
See application file for complete search history.

(56) References Cited

U.S. PATENT DOCUMENTS

| | | | | |
|---|---|---|---|---|
| 2,211,542 | A | 8/1940 | Howell | |
| 2,350,563 | A * | 6/1944 | Logan | 601/59 |
| 2,808,828 | A | 10/1957 | Rubin | |
| 4,152,795 | A * | 5/1979 | Rodosta et al. | 5/658 |
| 4,490,867 | A | 1/1985 | Gabrielsson | |
| 4,787,104 | A | 11/1988 | Grantham | |
| 5,228,155 | A * | 7/1993 | Shultz et al. | 5/109 |
| 5,404,603 | A * | 4/1995 | Fukai et al. | 5/609 |
| 7,234,179 | B2 | 6/2007 | Shaw | |
| 7,281,284 | B2 | 10/2007 | Sims, Jr. | |
| 2005/0091744 | A1 | 5/2005 | Mayyak | |
| 2007/0143924 | A1 | 6/2007 | Guo | |
| 2009/0211022 | A1 | 8/2009 | Harding | |
| 2010/0223724 | A1 | 9/2010 | Niwa et al. | |
| 2010/0325794 | A1 | 12/2010 | Chung et al. | |

* cited by examiner

*Primary Examiner* — Fredrick Conley
(74) *Attorney, Agent, or Firm* — Lyman Moulton, Esq.; Moulton Patents, PLLC

(57) ABSTRACT

A powered rocking bed, as disclosed, comprises a longitudinal push-pull rod medially connected to a powered driver, the rod configured to provide an oscillating push-pull longitudinal force on a first and second distal end about an axis there between and a plurality of upper and lower rollers disposed adjacent each distal end of the longitudinal push-pull rod.

20 Claims, 5 Drawing Sheets

POWERED ROCKING BED DEVICE

CROSS-REFERENCE TO RELATED APPLICATIONS

This application claims the benefit of the priority date of earlier filed U.S. Provisional Patent Application Ser. No. 61/505,488, filed Jul. 7, 2011 and U.S. Provisional Patent Application Ser. No. 61/547,215 filed Oct. 14, 2011 for James Flemister, each incorporated herein by reference in its entirety.

BACKGROUND AND FIELD OF INVENTION

Conventional firm and flat mattresses may not be very good at disturbing the body's weight and as a result, pressure hot spots may develop along a sleeper's body. Sleepers may toss and turn from one position to another, mainly to relieve these pressure points, which occur at various places along the body where one comes into contact with a mattress. If these pressure points could be alleviated or removed all together then a sleeper may be able to avoid tossing and turning during sleep and stay sleeping. Many people actually wake themselves from sleep as they reposition themselves to become more comfortable. This, obviously, is not conducive to sound sleep. It is therefore desirable that the body be relieved of the need to frequently change positions without actually having to be physically repositioned.

Some sleep experts have reported that the average person tosses and turns 40-60 times during the night. According to multiple scientific sleep studies, more than 70 million Americans may suffer from sleep disorders, such as acid reflux, inflammation, insomnia, sleep apnea, general stress related issues, toxicity, and other health related problems. Sleepers with these conditions experience difficulty initiating or maintaining sleep, often resulting in impaired daytime functioning. In one poll, 35 percent of all adults experienced sleep disorder symptoms every night, with 58 percent reporting insomnia at least a few nights per week. Additionally, more than 100 million Americans are, by definition, chronically sleep-deprived.

It is known that the rocking of a baby cradle helps a child to sleep and may have even given rise to the saying, 'sleep like a baby.' For an adult, a cruise ship may give an unusual and profound sleep experience and help one fall into a much deeper and more complete sleep than a passenger has experienced before. And after a couple of days on a cruise ship, a passenger may feel more youthful and walk with a "bounce" in their step. There may be several factors at play that allow a better sleep on a cruise ship. One factor may be the roll of the ship in response to ocean waves sufficient to generate movement of a passenger's bed (Beds placed head to foot in a bow to stem direction may not be affected by the ship's motion).

Some studies have shown that rocking increases blood and lymphatic circulation. The heart may pump blood and nutrients into the cells, but to carry toxins away from the cells, the body requires motion. This may be because the body's drainage system, the lymphatic system, has no pump. Doctors know that people without enough movement, or who are bed-ridden, may quickly develop serious health problems. For example after surgery, patients may be asked to get up and move around as soon as possible, even if exhausted and totally in pain. Rocking may therefore speed postoperative recovery and reduce pain.

Additionally, patients may find that rocking just feels good! By reducing backpressure in the circulatory system, rocking motion may decrease swelling throughout the body.

Muscles and tissues may stretch and relax during rocking. Soreness, aches, pain and swelling may also diminish noticeably right away through rocking. Rocking may be therefore much more relaxing and more therapeutic than simply lying down. Rocking may create a pumping action that increases circulation between the spinal discs and other joints, bathing a sleeper's cells in fresh nutrients. The nervous system may recognize this and send signals of pleasure to encourage the sleeper or rocker to continue.

Other benefits of rocking are being discovered and acknowledged at the frontiers of science. For example, rocking may increase oxygen delivery to the cells. The body burns calories via oxygen to generate electricity to power muscles and the nervous system. Reduced oxygen to the cells may therefore result in chronic pain, suffering and disease. Cells are starved for oxygen until the lymphatic vessels remove toxins, blood proteins, and water. Rocking promotes this electrochemistry, effectively turning on the "switch" to increasing overall health, energy, and alertness.

Traditionally, most sleep research has centered on the use of drugs or medicine to solve various sleep disorders. There is now sound evidence of the positive affect of rocking. Current sleep studies, as a whole, seem to be missing the link between the gentle, soothing rocking motion on the body's gravitational and lymphatic system and its connection thereto. Current research is discovering how important rocking is for psychosocial well-being; its use has spread far beyond the mother/child cradle, and can be a cure for a wide range of health to problems. Further studies have shown that the gentle motion of rocking may release endorphins, a chemical known to improve mood and lessen pain. The studies also indicate that rocking therapy may increase the quality of life for people suffering from Dementia and Alzheimer's disease.

Other studies have indicated the calming movement of rocking can dramatically speed up the healing process in severely ill patients. In addition, rocking may be used as therapy for post-surgery recovery. Cases have been reported of patients recuperating from heart attack and stroke—without any trace of permanent damage—simply because they used rocking therapy while they were recovering. People bedridden with arthritis may be up and around inside a week after regular use of rocking therapy. Rocking therapy may be applied to the following health issues, with remarkable results:

Dementia
Alzheimer's
Autism
Chronic Fatigue Syndrome
Stuttering
Diabetes
Arthritis
Heart Disease
Surgical Recovery
Mental Illness While a body is being rocked in a traditional rocking chair, the body is mostly upright in a sitting position. A body, while in a lying position, on the surface of a mattress being rocked may have similar forces acting upon it. A rocking bed may therefore have extremely positive uses in any and all rocking situations whereby one may be benefited by its rocking motion.

However, much of the bedding industry has sought to solve the problem of a body's weight bearing down on a flat, non-moving bed surface by either softening or contouring mattress surfaces. There are hundreds of inventive ideas in the prior art dealing with the improvement of the sleep surface but none have been found that seek to move the mattress in ways that preclude a sleeper from having to reposition themselves during sleep and offer therapeutic benefits at to the same time.

SUMMARY OF THE INVENTION

A powered rocking bed, as disclosed, comprises a first and a second longitudinal push-pull rod connected at a respective proximal end to a powered driver, the rods configured to provide an oscillating push-pull longitudinal force on a respective distal end of each rod about an axis there between. The disclosed bedding device also includes a body support member medially connected to a pivot proximal the axis and hingedly connected at a foot and a head portion thereof to a respective distal end of each rod. The body support member is therefore configured to receive an oscillating head-foot vertical force component of the push-pull force.

An embodiment of the disclosed powered rocking bed comprises a longitudinal push-pull rod medially connected to a powered driver, the rod configured to provide an oscillating push-pull longitudinal force on a first and second distal end about an axis there between and a plurality of upper and lower rollers disposed adjacent each distal end of the longitudinal push-pull rod. The disclosed bedding device also includes a head and a foot longitudinal slide rail configured to receive a respective distal end of the push-pull rod, the slide rails configured to provide a sliding surface for the lower cam rollers and transfer the push-pull force into an oscillating head-foot vertical force at the upper rollers. The disclosure further includes a body support member medially connected to a pivot proximal the axis, the member configured to receive the oscillating head-foot vertical force from the upper rollers on a respective head and foot portion thereof.

Another embodiment of the disclosed powered rocking bedding device includes a first and a second longitudinal push-pull rod connected at a respective proximal end to a powered driver. The rods are configured to provide an oscillating push-pull longitudinal force on a respective distal end of each rod about an axis there between. The embodiment also includes an upper and lower control arm hingedly connected to a respective distal end of each rod, each control arm connected to the respective distal end at a proximal end and a distal end thereof having a sliding member. At least one head slide rail and one foot slide rail are each configured to receive the upper and lower control arms, the slide rails configured to provide a sliding surface for the sliding members and transfer the push-pull force into an oscillating head-foot vertical force; and a body support member configured to receive the oscillating head-foot vertical force proximal a respective head and foot portion thereof. The body support member is medially connected to a pivot proximal the axis.

Other aspects and advantages of embodiments of the disclosure will become apparent from the following detailed description, taken in conjunction with the accompanying drawings, illustrated by way of example of the principles of the disclosure.

Figure 1A:
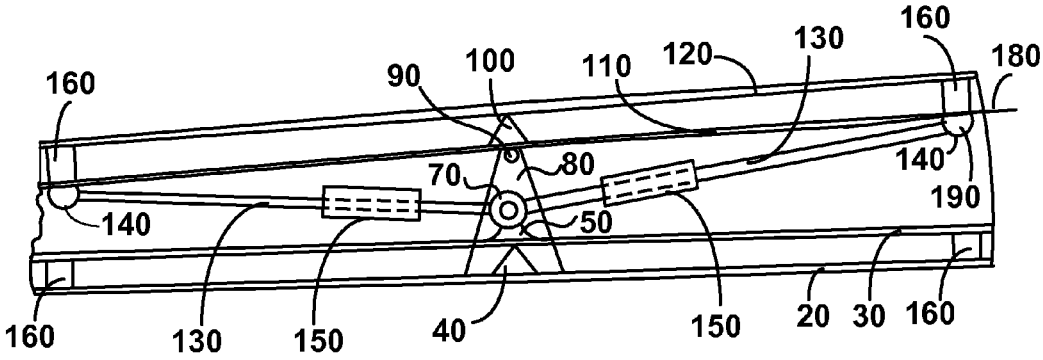
FIG. 1A is a side elevational view of a longitudinally oscillating dual rod rocking bed in a head up position in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Throughout the present disclosure, the term 'sleeper' may refer to a person, pet, animal and any other living thing in a somnambulistic state. The term 'bed' may refer throughout to at least one of a mattress, a box spring or mattress to support and to both the mattress and the support as a bedding unit.

FIG. 1A is a side elevational view of a longitudinally oscillating dual rod rocking bed in a head up position in accordance with an embodiment of the present disclosure. The powered rocking bed, as disclosed, comprises a first and a second longitudinal push-pull rod 130 connected at a respective proximal end to a powered driver 70, the rods 130 configured to provide an oscillating push-pull longitudinal force on a respective distal end 140 of each rod about an axis 210 there between. The disclosed bedding device also includes a body support member 120 medially connected to a pivot 90 proximal the axis 210 and hingedly connected at a foot and a head portion thereof to a respective distal end 140 of each rod.

The body support member 120 is therefore configured to receive an oscillating head-foot vertical force component of the push-pull force.

The disclosed rocking box spring in the head up position depicts the right side head up and the left side foot down. A rectangular shaped base frame 20 supports a rectangular and upper base frame 30. Base frames 20 and 30 are connected at or near the four corners by coil compression support springs 160 that can be selected to provide optimal support, they may or may not be of equal spring constants. A mid-base support 40 that could be triangular, circular, or elliptical and transverse or in separate sections is positioned to provide additional support to overall box spring at base frame 20.

The drive mechanism of the disclosure may consist of a D.C. (direct current) gear motor 60, flywheel or cam 70, mounting bracket for D.C. gear motor and flywheel assembly 50, upper base frames 110 and 120, and upper base frame support 80. The base frame support 80 for the common axis or pivot point 90 may be triangular, circular, or elliptical and transverse and any geometrical configuration or a combination thereof. Additionally, coil compression or fluid filled support springs 160 may be located at or near the four corners of and between upper base frames 110 and 120. The springs 160 provide a cushion effect and add to the overall structural integrity of the entire rocking box spring device. Main support bracket 80 is affixed to lower base frame 20 and attached at upper bracket end, to middle, upper base frame 110 at pivot point 90 on lower rocker base frame. In use, the gear motor 60 rotates the flywheel disc 70 which then effects two opposing push rods 130 connected at flywheel horizontal output shaft 200 and both push rods are connected at their opposite ends at push rod bracket points 140 and bearing point 190 specifically.

Push rod bracket 140 is affixed to the lower surface of upper rocker base frame 110. In-line components 150 may be springs, dampening or shock absorbing devices configured to eliminate sudden motion from the transfer of a push force to a pull force in the rods 130. Thus, as actuation occurs, via the motor 60 that drives the horizontal output shaft 200, a smooth and gentle rolling "cam" motion is brought into play, this effects a cyclic rolling and rocking (seesaw) motion on the upper base frames 110 and 120, in a longitudinal direction, such that the resultant movement would be transferred to a mattress placed upon the upper base frame 120. Additionally, surfaces of the disclosure may even incorporate a type of vibrating massage device for further relaxation. Details of the flywheel 90 are shown in FIG. 1C.

Figure 1B:
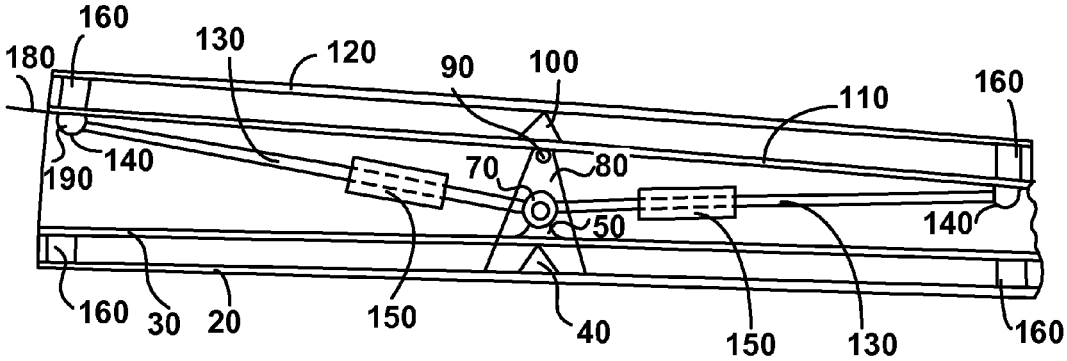
FIG. 1B is a side elevational view of a longitudinally oscillating dual rod rocking bed in a head down position in accordance with an embodiment of the present disclosure.

FIG. 1B is a side elevational view of a longitudinally oscillating dual rod rocking bed in a head down position in accordance with an embodiment of the present disclosure. The disclosed rocking box spring is depicted in the head down position with the left side up and the right side down in relation to the floor. All of the drive elements and components are similar or the same as in FIG. 1A. Details of the flywheel are shown in FIG. 1C below. The foot and head portions of the support member 120 dip-down and tip-up above a horizontal plane comprising the pivot 90 proximal the axis 210, the dip-down and tip-up motions comprising an arc inertia motion as further described below. The dip-down and tip-up motions may exceed the horizontal plane by a nominal three-quarters of an inch or more.

Figure 1C:
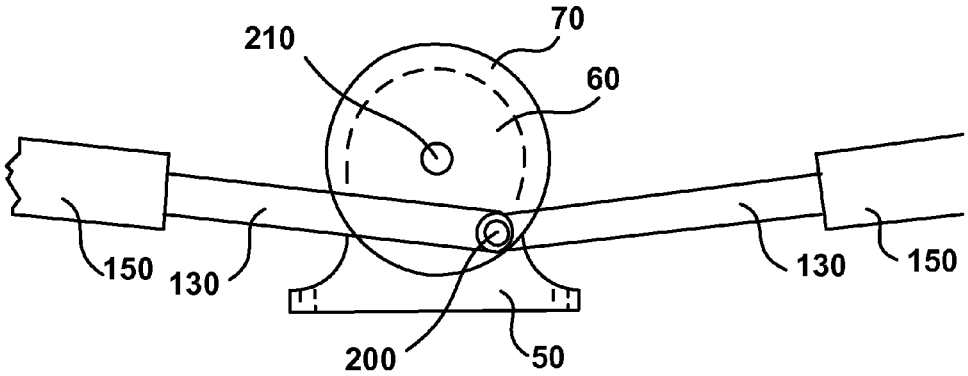
FIG. 1C is a side elevational view of a longitudinally oscillating dual rod flywheel in accordance with an embodiment of the present disclosure.

FIG. 1C is a side elevational view of a longitudinally oscillating dual rod flywheel in accordance with an embodiment of the present disclosure. The flywheel 70 rotates about axis 210. The cam 200 eccentrically connects proximal ends of the push-pull rods 130 to a perimeter of the flywheel 60. Components 150 may be configured to eliminate sudden motion from the transfer of a push force to a pull force in the rods 130. The mounting bracket 50 disposes the motor 60 (broken lines) to the frame 30. The push-pull and flywheel cam action is designed to invoke a random or a pre-determined controlled, and novel, "arc inertia motion", in the head to foot direction, that is transferred in a unique and novel way to a body lying or sitting on the upper surface. Thus, providing a drug free, simple way to reduce stress and prepare the sleeper to fall asleep quickly and deeply.

An embodiment of the powered rocking bed may further comprise a second pair of push-pull rods connected to a second independently powered driver, the second pair of rods configured to provide a second oscillating push-pull longitudinal force respectively on a first and a second distal end of the second rod pair. The second rod pair may be hingedly connected at a foot and a head portion of the support member configured to receive a second oscillating head-foot vertical force component of the push-pull force from the second rod pair. Therefore, a head to foot and a side to side rocking motion may be independently delivered to a sleeper and independently controlled by the sleeper.

Figure 2A:
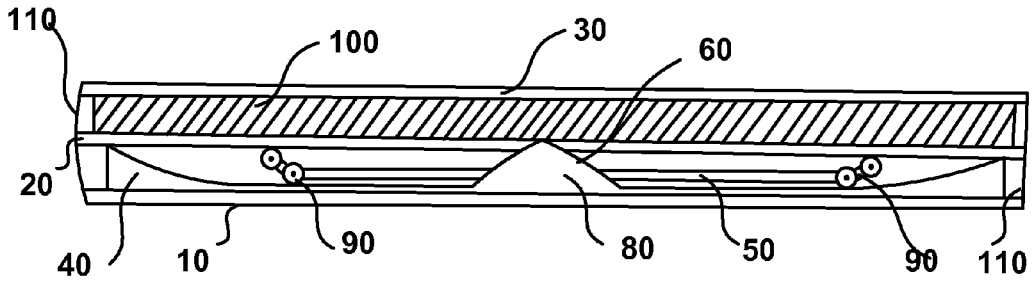
FIG. 2A is a side elevational view of a longitudinally oscillating dual rod rocking bed having a slide rail design, the bed in a horizontal position in accordance with an embodiment of the present disclosure.

FIG. 2A is a side elevational view of a longitudinally oscillating dual rod rocking bed having a slide rail design, the bed in a horizontal position in accordance with an embodiment of the present disclosure. A longitudinal push-pull rod 50 may be medially connected to a powered driver situated behind the frame support 80. The rod 50 may be comprised of a left and a right rod with respect to a medial drive point 70 engaged with a gear driver (not depicted). The rods 50 may be configured to provide an oscillating push-pull longitudinal force on a first and second distal end about an axis there between and a plurality of upper and lower rollers 90 disposed adjacent each distal end of the longitudinal push-pull rods 50. At least one lower roller may be configured to engage a slide rail 40 and at least one upper roller may be configured to engage the body support member 20. The disclosed bedding device also includes a head and a foot longitudinal slide rail 40 configured to receive a respective distal end of the push-pull rod, the slide rails 40 configured to provide a sliding surface for the lower cam rollers 90 and transfer the push-pull force into an oscillating head-foot vertical force at the upper rollers. The disclosure further includes a sleeping support or a body support member 30 medially connected to a pivot proximal the axis adjacent an upper support member 80. The sleep support or body support member 30 may be configured to receive the oscillating head-foot vertical force from the upper rollers 90 on a respective head and foot portion thereof.

A rectangular shaped base frame 10 supporting two or more parallel to rocker slide rails 40 and affixed to opposite longitudinal sides of base frame 10. At, or near, the mid-points of said parallel slide rails 40 is attached triangular, circular, or elliptical and transverse or in separate sections, upper frame supports 80 and swivel mechanism 70 that is affixed to parallel rocker slide rails on opposite sides, and can be more than two, of lower base frame.

Riding atop the two, or more, parallel rocker slides is a sled device consisting of a rectangular framed mechanism attached at all four corners to slide wheel assemblies 90, and consisting to two or more slide wheel assemblies 90. Atop centrally located, and attached to upper frame support brackets 80 and at swivel mechanisms is mid-frame support 20. In between mid-frame support 20 and upper frame support 30 is a rectangular layer of Styrofoam™ or similar material to the medial support 100 that is glued to the upper surface of mid-frame support 20 and the lower surface of upper frame support 30. Thus, as actuation occurs, via the motor 60 that drives the sled device too or fro in the head and foot direction, the resulting movement of sled causes a direct and responsive movement to occur upon the upper structure consisting of 20, 100, and 30, thus, invoking a random or a pre-determined, controlled, and novel and unique, "arc inertia motion", in the head and foot direction to the body lying or sitting on the upper surface 30. A mattress of any kind may be placed upon the upper base frame 30 for additional comfort to the sleeper.

The disclosed mechanism is designed to, when acted upon, move in such a way as to provide a controlled, soothing, relaxing and gentle rocking or "see-saw" movement to a mattress or similar sleeping surface, resting upon the upper frame support 30. This resulting motion is activated by a remote controller (not shown) which will control the rhythmic speed, as well as, the degree of movement delivered to the riding mattress above (not shown in drawing). The gear drive mechanism may be located between the two or more, parallel slide rails 40 and at or near the middle of rocking box spring device.

The drive mechanism of an embodiment of the disclosure may consist of a D.C. gear motor, a hydraulic, pneumatic, a windup motor or any other device for sliding the sled to-and-fro in a head and foot direction. An embodiment of the disclosure may include a hydraulic drive mechanism including a compression system on two or more master cylinders that actuate four or more to hydraulic pods located at or near the four corners of the bed device. The driver motor may be attached to lower base frame 10 and also attached to a linkage or gear assembly (not shown in drawing) designed to move complete slide assembly and 90 in a to-and-fro longitudinal direction, in a controlled manner, so as to produce a smooth and gentle rolling "cam" action effect to the uppermost rocker mechanism consisting of 20, 100, and 30 and is similar to the cam effect as shown in FIG. 1C. This motion may provide the necessary sensation to the intended sleeper above, that would induce the most rapid and deepest sleep state possible. This is the finest, easiest and simplest process available to induce a sleeper to this state naturally, without resorting to the use of toxic and expensive drugs. It is further believed, by this inventor, that resorting to such means as drug induced sleep states can contribute to serious health risks.

Figure 2B:
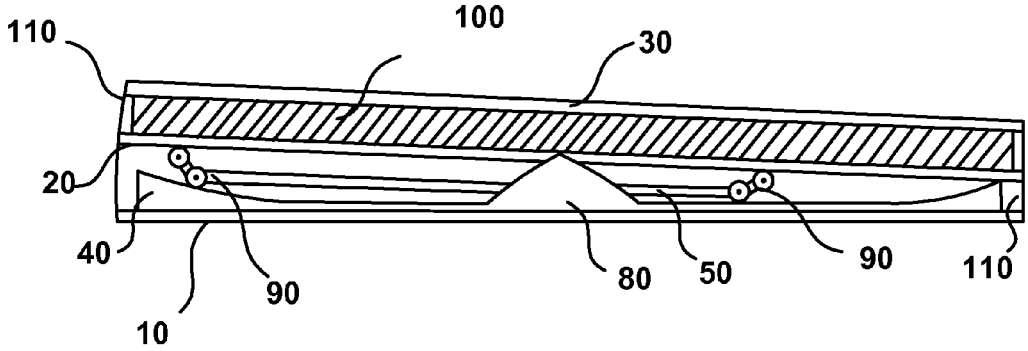
FIG. 2B is a side elevational view of a longitudinally oscillating dual rod rocking bed having a slide rail design, the bed in a head down position in accordance with an embodiment of the present disclosure.

FIG. 2B is a side elevational view of a longitudinally oscillating dual rod rocking bed having a slide rail design, the bed in a head down position in accordance with an embodiment of the present disclosure. The disclosed rocking box spring is depicted in the head below foot position with the left side up and the right side down. In this position we can see the sled 50, along with the roller assemblies 90, have moved to the left, up the inclined plane, in such a manner as to lift the foot end above the horizontal position and the head end below the horizontal position. As this action occurs, it initiates the necessary force upon the underside of mid-base frame 20, which is joined by 100 and 30, to move in an exact and simultaneous direction. As this too and fro, or "see-saw" motion is generated by the action of the drive mechanism, it causes the upper frame surface 30 to move in the proper motion or manner as described above in this detailed description. All the drive elements are the same as in FIG. 2A.

An embodiment of the present disclosure may include one of a linear ramp configured to provide a linear rise and fall motion on the foot and head portions of the sleeping support member and an arcuate ramp configured to provide a non-linear rise and fall motion on the foot and head portions thereof. Also, the proximal ends of the push-pull rods may include geared teeth. The geared teeth may be configured to mate with a powered geared driver adjacent the medial axis, the driver configured to provide the oscillating push-pull longitudinal force respectively on the first and the second rods. A protective and flexible material may substantially encase the disclosed powered bed, the material configured to provide a sound proofing effect and an aesthetic appearance similar to a standard bedding box spring.

Embodiments of the disclosure may also include configurations with multiple ramps for each push-pull rod. A pair of complementary ramps disposed on an underside 20 of the support structure and on an upper side the structure 10 may provide the arc inertia movement via rollers equidistantly fixed at distal ends of the push-pull rods. In other words, as the rollers of a 'foot' push-pull rod are moving down an incline of a pair of ramps, the 'head' push-pull rod is moving up the incline of another pair of ramps and therefore elevating the support structure and the head of the bed thereon while lowering the foot of the bed with respect to a horizontal plane. Each ramp in a ramp pair may therefore be configured as right triangles with the 'rise' side of each triangular ramp on a common axis and the run of each triangular ramp running parallel to each other and affixed to its respective surface (surface 20 or 10 depicted in FIGS. 2A and 2B). A hypotenuse of each ramp therefore being in contact with a respective roller on the same distal end of a push-pull rod may move the two surfaces 10 and 20 apart from each other like opening and closing a jaw comprising the two ramps. Other similar designs are also included in embodiments of the present disclosure as suggested and/or taught herein.

Figure 3A:
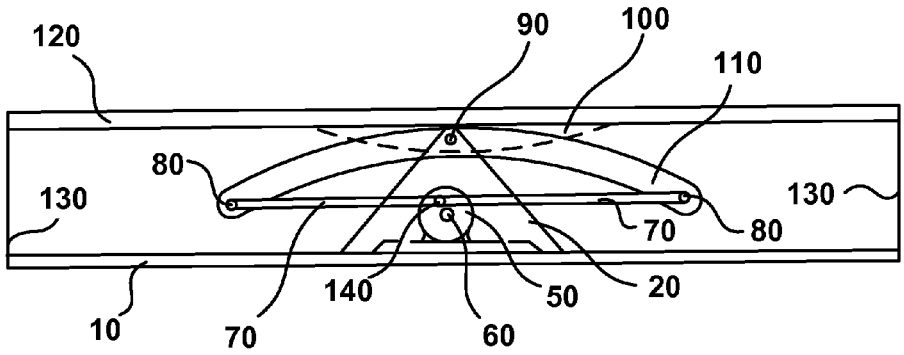
FIG. 3A is a side elevational view of a longitudinally oscillating dual rod rocking bed having an upper support bracket design, the bed in a horizontal position in accordance with an embodiment of the present disclosure.

FIG. 3A is a side elevational view of a longitudinally oscillating dual rod rocking bed having an upper support bracket design, the bed in a horizontal position in accordance with an embodiment of the present disclosure. The powered rocking bed, as disclosed, comprises a first and a second longitudinal push-pull rod 70 proximally connected to a powered driver. The rods 70 may be configured to provide an oscillating push-pull longitudinal force on respective distal ends of the rods 70 about an axis 140 there between. The disclosed bedding device also includes a body support member 120 medially connected to a pivot 90 proximal the flywheel axis 60 and hingedly connected at the upper support bracket 110 to a respective distal end 140 of each rod. The body support member 120 is therefore configured to receive an oscillating head-foot vertical force component of the push-pull force.

The disclosed rocking box spring is depicted in the head and foot horizontal position where the right side is horizontal and the left side is horizontal. A rectangular shaped lower base frame 10, supporting two, or more, laterally and mid-positioned rocker pivot brackets 20 could be triangular, or elliptical and transverse or in two or more separate sections is positioned to provide support for 90,100,110 and 70. Said brackets are opposite one another, or can be positioned in line with one another transverse wise, and supports rocker pivot rod 90, which in turn, runs directly and laterally or transversely through center of upper base frame support bracket 100. Upper base frame support bracket 100 is affixed to lower surface of upper base frame 120. Lower base frame 10, supports the drive mechanism of an embodiment which can consist of a D.C. gear motor 40, flywheel or cam 50, mounting bracket for D.C. gear motor, drive shafts 70, rocker arms 110, pivot rod 90, upper base frame bracket 100 and upper base frame 120, positioned at or near middle of base frame 10.

An embodiment of the rocking mechanism includes a flywheel 30 attached to a horizontal drive shaft protruding from gear box attached to a gear motor or to any number of other sundry drive mechanisms. As flywheel 50 is activated, it moves two separate and same length push rods 70, also known as drive shafts are attached to horizontal armature 140, coming off of and attached to outer circumference of fly wheel 50. As push rods 70, are moved slowly in a longitudinal direction, and in fore and aft cyclic directions, by the action of the flywheel 50, a "cam" motion is exerted upon the push rods. As the opposing ends of each push rod are attached to swivel connects 80 located at opposite ends of rocker pivot arm 110, said rocker pivot arm 110 then pivots at rocker pivot rod 90. The rocker pivot arm 110 is affixed to upper base frame support bracket 100 and the upper base frame support bracket 100 is affixed to the lower surface of the upper base frame 120. Details of the flywheel 50 are the same as shown in FIG. 1C.

As the entire drive mechanism composed of 50, 60, 140, 70, 80, 110, 90, 100, and 120 moves under power, it acts upon the upper base frame such that any mattress resting upon upper surface of upper base frame 120 will be moved in a random or a pre-determined, controlled, unique and novel, "arc inertia motion", in the head and foot direction. Thus, any person lying on a mattress that is resting upon the upper surface of this rocking box spring device will succumb to the gentle and soothing head and foot rocking, rolling or see-saw motion that is exerted upon said mattress.

A sleeper using the disclosure, may have a strong tendency to relax, and shortly, to fall into a very deep and serene sleep state. This action claimed by the disclosure is designed to deliver a soothing, gentle and relaxing sensation to the body laying or sitting on the mattress surface above the rocking box spring bed device. Thus, providing a drug free, best way to reduce stress and prepare the sleeper to fall asleep quickly and deeply.

Figure 3B:
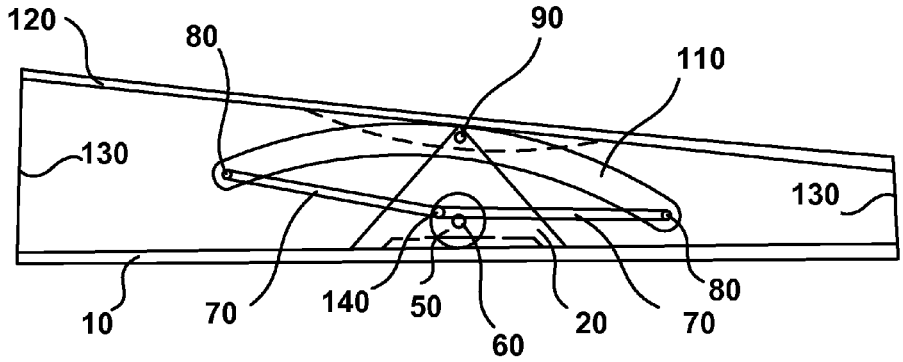
FIG. 3B is a side elevational view of a longitudinally oscillating dual rod rocking bed having an upper support bracket design, the bed in a head down position in accordance with an embodiment of the present disclosure.

FIG. 3B is a side elevational view of a longitudinally oscillating dual rod rocking bed having an upper support bracket design, the bed in a head down position in accordance with an embodiment of the present disclosure. The disclosed rocking box spring is depicted in the head below foot position with the left side up and the right side down. Details of the flywheel are the same or similar as shown in FIG. 1C. All of the drive elements are similar or the same as those in FIG. 1A. In this position, it can be seen that the rocker arm 110 has been moved up on its left side and down on its right side, thus, moving the upper base frame in an exactly similar manner. The head end is now in the down position (below the horizontal level) and the foot end is in the up position (above the horizontal level). As this back and forth, up and down motion occurs, when activated, a gentle, soothing, rocking or see-saw motion is transferred to a body laying or sitting upon the surface of any mattress resting atop upper base frame 120.

An embodiment (not depicted) includes the disclosed rocking box spring in the head and foot horizontal position with the right and left sides horizontal to each other. A rectangular lower base frame may support a drive mechanism that may consist of a D.C. gear motor or any other sundry drive mechanisms such as hydraulics, pneumatics, a wind-up apparatus or any other drive mechanism that drives a back and forth drive linkage assembly. This linkage may be similar to the detail in FIG. 1C and may be mounted in the vertical direction and is attached to rocker arm, at a lower rocker arm swivel point. For aesthetic appearance and complete safety, the entire rocking box spring device may be covered in a material that may give the device the appearance of a standard box spring. Additionally, the disclosure may be encased in a box-type rectangular wooden, plastic, metal or any other hard material for safety, aesthetics and soundproofing purposes. The covering material may have the stretching capability to expand and shrink, as needed, to accommodate the rocking motion of said device.

The rocker arm may connect at a rocker arm pivot point to rocker arm support brackets located in an approximate middle and on either side of base frame in transverse position firmly affixed to a lower base frame. The top of the rocker arm may attach to an upper base frame support plate. The upper base frame support plate is firmly affixed to a lower surface and middle of upper base frame. A motor housing cover and a drive mechanism cover are for the purpose of safety and sound proofing.

Thus, as actuation occurs, via the movement placed upon the upper base frame and the drive mechanism. The disclosed mechanism thus may invoke a random or pre-determined, unique and novel "arc inertia motion", in the head and foot direction that is transferred to a lying or sitting body on the upper surface. This action is designed to deliver a controlled, gentle and relaxing sensation to the body laying or sitting on a mattress surface, of any kind, resting on the surface of upper frame base. When in use, the D.C. drive gear motor actuates a "back and forth" drive linkage assembly in a "cam" motion. The rocker arm may be attached to the drive linkage assembly at a lower rocker arm swivel point. As the rocker arm is then moved back and forth in a longitudinal, head and foot direction, the resulting "cam" and "arc inertia motion" may cause the rocker arm to pivot back and forth in a longitudinal, head and foot, direction causing the upper base frame support plate to dip down our tip up, above the horizontal line, in a smooth downwards and upwards fashion and at the upper and lower ends of the movement cycles. As the upper base frame support plate is affixed to upper base frame above, it may mirror the same identical movement and transfer the same movement to any mattress riding on the upper surface of upper base frame. This action may produce a slow, gentle, rhythmic, relaxing and continuous sensation to a body reclining or sitting on the rocking mattress above.

Therefore, the disclosure induces an extremely relaxing and comfortable sensation to a resting person and may dispose them to fall rapidly and deeply into a sleep state. Further, as a sleeper sleeps with this continuous gentle and soothing motion, acting upon his/her body, the shifting center of gravity acting upon the body alleviates the need, or feeling, to constantly move or rotate one's own body's on the sleep surface as is normal on a flat, non-moving, surface.

Additionally, a detoxifying effect is also initiated and maintained throughout the sleep cycle as the person sleeps. This is caused by virtue of the up and down motion of gravity acting upon the body while sleeping. It is well known in medical science and physiology that the up and down movement of gravity, acting upon a body, activates the lymphatic glands and, thus, flushes toxic waste and other poisons from the glands by virtue of this process.

Another embodiment (not depicted) includes the disclosed rocking box spring in the head below foot position where the right side is down and left side is up. In this position a rocker arm has had its lower end moved to the left by the drive mechanism. Its upper end that is affixed to upper base frame plate is causal to the movement of the upper base frame to be raised up on the left and down on the right resulting in the head below foot position. Thus, may be accomplished a movement to transmit the comfortable, smooth, effective and relaxing sensation to a laying or sitting body on the above sleep surface. A mattress of any kind may be placed upon the surface for further comfort to bring about a rapid and deep sleep state.

Figure 4A:
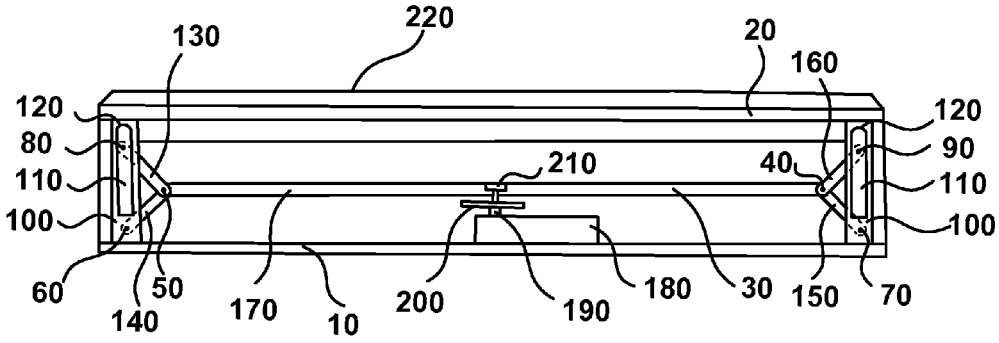
FIG. 4A is a side elevational view of a longitudinally oscillating dual rod rocking bed having a control arm and sleeve design, the bed in a horizontal position in accordance with an embodiment of the present disclosure.

FIG. 4A is a side elevational view of a longitudinally oscillating dual rod rocking bed having a control arm and sleeve design, the bed in a horizontal position in accordance with an embodiment of the present disclosure. The disclosed powered rocking bedding device includes a first and a second longitudinal push-pull rod 30 and 170 connected at a respective proximal end to a powered driver 180. The flywheel 200 is situated horizontally in a 'pancake' type configuration. However, an upright configuration, an elliptical cam and a semi-circular flywheel may also be used in embodiments of the disclosure. The rods 30 and 170 are configured to provide an oscillating push-pull longitudinal force on a respective distal end of each rod about an axis 210 there between. The embodiment also includes an upper left and a lower left control arm 130 and 140 respectively and an upper right and a lower right control arm 160 and 150 respectively. The control arms 130, 140, 150 and 160 may be hingedly connected to a respective distal end of each rod. At least one head (right side) slide rail and one foot (left side) slide rail are each configured to receive the upper and lower control arms, the slide rails configured to provide a sliding surface for the sliding members and transfer the push-pull force into an oscillating head-foot vertical force. A body support member may be configured to receive the oscillating head-foot vertical force proximal a respective head and foot portion thereof. The body support member is medially connected to a pivot proximal the axis.

The disclosed rocking box spring is depicted in the head and foot horizontal position with the right side horizontal and the left side is horizontal in relation to the floor. A rectangular lower base frame 10 supports a drive mechanism consisting of a D.C. gear motor 180 or any other number of drive mechanisms that may be affixed to center mid-point of lower base frame 10. Affixed to armature 190, and protruding from D.C. gear motor 180, is a "cam" drive flywheel 200, that is attached to cam drive flywheel pin 210, that connects to inner drive shafts 170 and 30 at mid-point of the powered rocking box spring bed device.

The opposite ends of drive shafts 170 and 30, and at opposing ends of rocking box spring device, are attached, and in the exact middle position and in lateral or transverse direction to the longitudinal, is connector actuator cross bars 230. These two parallel cross bars are, in turn, connected to four separate and distinct slider sleeve assemblies 230, located at or near four corners of the powered rocking box spring bed device. The four slider sleeve assemblies are composed of eight separate control arms (four depicted: 130, 140, 150 and 160) located on both sides and at or near all four corners of the disclosure and are connected to drive mechanism cross-bars 230 at or near all four corners.

Furthermore, the opposite ends of the slider sleeve assembly's, composed of control arms 130, 140, 150 and 160 are attached to the yoke mechanisms 100, in such a way that as the drive mechanism is in use, two of the slider mechanisms at one end of the rocking box spring expand, while at the opposite ends, the two 150 and 160 shrink. The lower control arms, 140 and 150, while positioned at or near all four corners at points 60 and 70, only pivot at points 60 and 70, while the upper control arms 130 and 160 are designed to move in an up and down manner, within their respective yoke mechanisms 100, when pressure is either exerted upon them or retracted from them at their connect points 40 and 50, by the "cam" actions of push rods 30 and 170.

The upper ends of these control arms 130 and 160, at or near the four corners, are attached to slider sleeves 120 at points 80 and 90, at or near all four corners. The slider sleeves move either up or down in the open space 110 of the four separate yoke mechanisms 100, as either upward or downward pressure is exerted upon them by the control arms 130 and 160. As longitudinally opposing and transverse slider sleeves 120 are either ascending or descending, in opposition to one another, while in use, they are affecting an oscillation, cam like, movement acting upon upper mattress support member 220, that is supported at or near all four corners by the slider sleeves 120. Mattress support member 220 is protected and surrounded on all four of its sides by upper box spring frame 20. The entire rocking box spring device is covered in a durable and stretchable material for aesthetic appeal, soundproofing, and most of all, safety purposes. By the use of this covering method, pinch points are virtually eliminated. Thus, safety is assured for the user/users, as well as, for infants, animals and the like. Details of the flywheel 200 are shown in FIG. 1C.

As the gentle, relaxing "cam" like and controlled, head and foot rocking or see-saw motion occurs in the longitudinal direction, this action is transferred to any type mattress riding atop the upper surface of mattress support member 220. Thus, producing the most effective and efficient type of motion, in this inventor's estimation, learned by personal experience and research, has proven to be the most conducive movement to bring about a drug free, sound, rapid and deep sleep state.

Figure 4B:
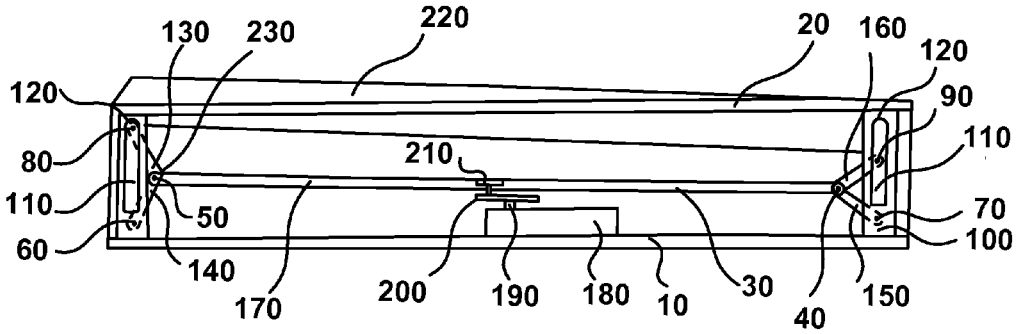
FIG. 4B is a side elevational view of a longitudinally oscillating dual rod rocking bed having a control arm and sleeve design, the bed in a head down position in accordance with an embodiment of the present disclosure.

FIG. 4B is a side elevational view of a longitudinally oscillating dual rod rocking bed having a control arm and sleeve design, the bed in a head down position in accordance with an embodiment of the present disclosure. The disclosed rocking box spring is depicted in the head down position with the left side up and the right side down. All the drive elements are similar or the same as those in previous figures. Details of the flywheel are shown in FIG. 1C. In this position, we can see how the drive mechanism, encompassing the entire structure and suspended within its outer structure composed of lower base frame 10 and upper box spring frame 20, and the four yoke mechanisms 100 located at or near all four corners of the rocking box spring provides, when in use, a specific, smooth "cam" like motion and controlled, head to foot direction to a lying or sitting body on the upper surface.

An embodiment of the disclosure may include a distance between the distal ends of a pair of control arms received in a head slide rail which may expand to raise a head portion of the body support member. At the same time, a distance between the distal ends of a pair of control arms received in a foot slide rail may shrink to lower a foot portion of the body support member and vice versa with respect to a lower head portion and a higher foot portion of the support member. Also, a sliding member may include at least one of a roller and a sliding pin and the like. Additionally, a powered driver may be configured in at least one of a horizontal 'pancake' configuration, an upright configuration, an elliptical cam configuration and a circular flywheel configuration. Furthermore, at least one head and one foot slide rail may be respectively configured into a vertical sleeve to receive one of a roller and the sliding pin of each control arm in order to transfer the push-pull longitudinal force into an oscillating head-foot vertical force. A slide rail sleeve may be disposed proximal at least one of an end and a corner of the powered bed.

Figure 5:
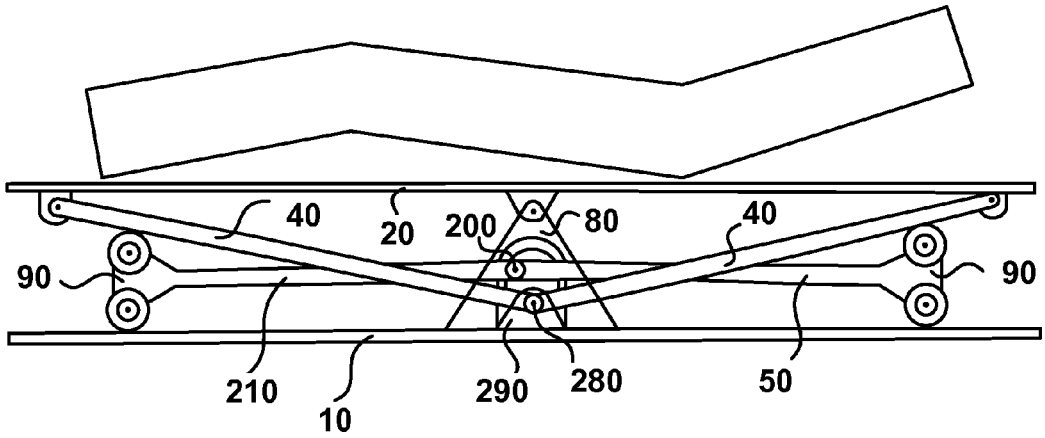
FIG. 5 is a side elevational view of a longitudinally oscillating dual rod rocking bed having a slide rail rod design and an adjustable bed, the bed support in a horizontal position in accordance with an embodiment of the present disclosure.

FIG. 5 is a side elevational view of a longitudinally oscillating dual rod rocking bed having a slide rail rod design and an adjustable bed, the bed support in a horizontal position in accordance with an embodiment of the present disclosure. The depicted embodiment includes a base frame 10, an upper base frame 20, a pair of pivot arms or slide rails 40, push-pull rods 50, upper frame support 80 and the slide wheel assembly 90. A mattress (shown in a bent configuration) is disposed on the upper base frame 20. Details of the drive and cam assembly may be similar to that depicted in FIG. 1C. The pivot arms or slide rails 40 provide a ramping surface for an upper wheel of the slide wheel assembly 90 to act against. The base frame acts as a flat surface for a lower wheel of the slide wheel assembly 90 to roll against. The hinge or pivot 280 anchors the rails 40 to the bracket 290. Other elements depicted in FIG. 5 may be similar or the same as elements described above in other figures.

This entire system or structure can be totally self-contained in a flat-bed structure of its own or an adjustable bed structure or piece of furniture in and of its self. These systems, mechanisms or devices would be totally self-contained in one structure and covered with any number of suitable materials for aesthetic appeal and safety purposes. It is intended this self-contained structure configuration could also be used in a child's bed, a baby crib, an animal bed, indoor and outdoor furniture or any other number of applications where a smooth, relaxing and gentle rocking motion in the head to foot direction and in the manner described in this application is desired. Embodiments of the disclosure include the drive mechanism and other moving parts may be soundproofed and insulated to ensure a sound sleeping experience for the sleeper.

In another embodiment (not depicted), the disclosed rocking box spring depicts the rocking box spring in the head and foot horizontal position where the head and foot are both in the horizontal position. A rectangular lower base frame is the basis of support for a D.C. gear motor or any other drive mechanism, rather hydraulic, pneumatic, water powered or otherwise and a skeletal structure supports the drive train mechanism. The drive train mechanism consists of a D.C. gear motor, a flywheel, a push rod, a rocker suspension arm, a mid-base frame support, an upper base frame and a foam mattress rest support. The gear motor slowly drives the flywheel that is connected by a horizontal armature protruding from the D.C. gear motor.

The push rod may be connected to the flywheel at a swivel connection. An opposite end of the push rod 70 may connect to a rocker suspension arm at the swivel connection. At the opposite end of the skeletal structure support 120 is a rocker suspension arm. The rocker suspension arm is disposed such that it swings freely from an inside section of the skeletal structure support. The rocker suspension arm thus acts in unison with the action exerted upon it and is therefore attached inside of skeletal structure support at the swivel connection. Details of the flywheel are shown in FIG. 1C.

As a push/pull rocking motion is exerted upon the suspension rocker arm via the push rod, the exact motion is exerted upon the mid-base frame support, as it is firmly affixed to both the suspension rocker arms located on both transverse and opposite sides of skeletal structure support at the swivel connects. Thus, a push/pull, smooth and gentle, "cam" and "arc inertia" motion, in the head and foot direction, is applied to the mid-base frame support and to the foam mattress rest support. The purpose of foam mattress rest support is to invoke a random or a pre-determined, controlled, unique and novel, "arc inertia" and "cam" like motion, in the head and foot longitudinal direction, such that it effects a cyclic rolling and rocking (see-saw) motion that would be transferred to a mattress placed upon the foam mattress rest support. Finally, the entire disclosed bed device may be covered with a type of stretching or expandable material to provide a security feature, an aesthetic appearance to the overall device, as well as, having a sound proofing affect. Thus, action is designed to deliver a controlled, soothing, gentle and relaxing sensation to the body laying or sitting on any type of mattress resting atop the mattress rest support and creating the best, most easily achieved, drug free way known to this inventor to reduce stress and prepare the sleeper to fall asleep quickly and deeply.

Furthermore, in a disclosed embodiment (not depicted), when the rocking box spring is in the head down position, the push rod acting upon the suspension rocker arms is causal to the upper mattress support base rising at the foot end and descending at the head end. In use, this movement is enacted in a continuous, smooth, relaxing and oscillating fashion that renders the precise desired movement to the sleeping surface as this continuous, head and foot movement is transferred to a body laying or sitting on the mattress surface.

In yet another embodiment, a pivoting bracket may be used to convert the longitudinal action of the push-pull rods into a complementary head to toe vertical action to create the 'arc inertia' movement. At least two pivoting brackets may be disposed at or near the head and foot portions of the powered bed device, one bracket for each push-pull rod. Also a pivoting bracket may be disposed at or near each corner of the powered bed device in alternate embodiments of the disclosure. A push of a push-pull rod may create a downward motion on the mattress support structure via the pivoting bracket and a pull of the push-pull rod may create an upward motion on the mattress via the pivoting bracket. The bracket may therefore resemble an 'L' or a 'V' with one leg of the bracket attached to a push-pull rod and the other leg of the bracket attached to the support structure. The intersection of the two legs pivots about a stationary point in the bed structure. The pivot brackets may be fully enclosed within the powered bed device. The push-pull rods may be eccentrically powered by a flywheel or any other type of chain or gear transmission attached to an engine or motor.

An additional benefit that one may perceive while using the present disclosure is a type of full body, internal massage. The gravitational forces acting upon the body actually move the body weight and the internal organs shift ever so slightly such that it provides a gentle sensation to those organs. This motion also "increases circulation of blood and oxygen throughout the body while the user is sleeping. This adds to an overall sense of well-being and relaxation that is extremely conducive to a sound night's sleep and to overall health as well. Also, the disclosed powered bed device therapeutically treats sleepers with acid reflux because the rocking of the device does not go below a horizontal line from a sleeper's head to feet. In other words, the head end of the disclosed bed rises slightly as the foot end dips. The rocking mechanism disclosed may return to a level horizontal position as the rocker reverses to an opposite rocking position without dipping the head end of the bed.

An embodiment of the present disclosure may be designed to allow the user to simply replace their existing box spring with the subject Rocking Box Spring for any bed size including a single, twin, queen, king, crib sized bed and smaller sized beds suitable for animals and the like. This may allow the user of the rocking box spring to receive the benefits of the disclosure without the need to change the geometry of their existing bed system. A rocking adjustable bed or flatbed system could be either placed on top of the rocking box spring device or fully integrated into it as a rocking adjustable bed system device. The disclosed powered rocking bed device will work with adjustable beds and bed systems of various and sundry sorts, air beds, foam mattresses, firm mattresses, soft mattresses, Sealy Posturpedic, Sleep Number, Serta, Simmons, Pillow top, Denver Mattress Company, Leggett and Platt, as well as every known brand of mattress.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the to present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A powered rocking bed, comprising:

a first and a second longitudinal push-pull rod connected at a respective proximal end to a powered driver, the rods configured to provide an oscillating push-pull longitudinal force on a respective distal end of each rod about an axis there between; and a body support member medially connected to a pivot proximal the axis and hingedly connected at a foot and a head portion thereof to a respective distal end of each rod, the member configured to receive an oscillating head-foot vertical force component of the push-pull force.

2. The powered rocking bed of claim 1, wherein each push-pull rod is eccentrically connected to a powered flywheel disposed proximal the axis.

3. The powered rocking bed of claim 1, wherein the foot and head portions of the support member dip-down and tip-up above a horizontal plane comprising the pivot proximal the axis, the dip-down and tip-up motion comprising an arc inertia motion.

4. The powered rocking bed of claim 1, further comprising an upper support bracket configured to receive the distal ends of the rods hingedly connected thereto, the upper support bracket connected to the body support member proximal the pivot.

5. The powered rocking bed of claim 1, further comprising at least one of a spring element and a dampening element attached in-line to each distal end of the rods.

6. The powered rocking bed of claim 1, further comprising a base for the powered bed and at least one of a coil compression and a fluid filled compression support for at least one of an end and a corner of the base.

7. The powered rocking bed of claim 1, further comprising a second pair of push-pull rods connected to a second independently powered driver, the second pair of rods configured to provide a second oscillating push-pull longitudinal force respectively on a first and a second distal end of the second rod pair hingedly connected at a foot and a head portion of the support member configured to receive a second oscillating head-foot vertical force component of the push-pull force from the second rod pair.

8. A powered rocking bed, comprising:

a longitudinal push-pull rod medially connected to a powered driver, the to rod configured to provide an oscillating push-pull longitudinal force on a first and second distal end about an axis there between;

a plurality of upper and lower rollers disposed adjacent each distal end of the longitudinal push-pull rod;

a head and a foot longitudinal slide rail configured to receive a respective distal end of the push-pull rod, the slide rails configured to provide a sliding surface for the lower cam rollers and transfer the push-pull force into an oscillating head-foot vertical force at the upper rollers; and a body support member medially connected to a pivot proximal the axis, the member configured to receive the oscillating head-foot vertical force from the upper rollers on a respective head and foot portion thereof.

9. The powered rocking bed of claim 8, wherein the slide rails comprise one of a linear ramp configured to provide a linear rise and fall motion on the head and foot portions of the body support member and an arcuate ramp configured to provide a non-linear rise and fall motion on the head and foot portions thereof.

10. The powered rocking bed of claim 8, wherein the push-pull rod comprises geared teeth adjacent the medial axis, the geared teeth configured to mate with a powered geared driver configured to provide the oscillating push-pull longitudinal force respectively on the first and the second distal ends of the rod.

11. The powered rocking bed of claim 8, wherein the push-pull rod comprises a first and a second longitudinal push-pull rod rotationally connected at a respective proximal end to a powered flywheel, the rods configured to provide an oscillating push-pull longitudinal force on a respective distal end of each rod about an axis of the flywheel.

12. The powered rocking bed of claim 8, wherein the plurality of upper and lower rollers disposed adjacent each distal end of the rod comprise at least one lower roller configured to engage a slide rail and at least one upper roller configured to engage the body support member.

13. The powered rocking bed of claim 8, further comprising one of a direct current gear motor, a hydraulic motor, a pneumatic motor, a windup motor and any other motor configured to power the longitudinal push-pull rod.

14. The rocking bed of claim 8, further comprising a protective and flexible material substantially encasing the powered bed, the material comprising any wooden, plastic, metal and like composite materials thereof, the material configured to provide a sound proofing effect and an aesthetic appearance similar to a standard bedding box spring.

15. A powered rocking bed, comprising:

a first and a second longitudinal push-pull rod connected at a respective proximal end to a powered driver, the rods configured to provide an oscillating push-pull longitudinal force on a respective distal end of each rod about an axis there between;

an upper and lower control arm hingedly connected to a respective distal end of each rod, each control arm connected to the respective distal end at a proximal end and a distal end thereof having a sliding member;

at least one head and one foot slide rail each configured to receive the upper and lower control arms, the slide rails configured to provide a sliding surface for the sliding members and transfer the push-pull force into an oscillating head-foot vertical force; and a body support member configured to receive the oscillating head-foot vertical force proximal a respective head and foot portion thereof, the support member medially connected to a pivot proximal the axis.

16. The powered rocking bed of claim 15, wherein a distance between the distal ends of a pair of control arms received in a head slide rail expands to raise a head portion of the body support member while a distance between the distal ends of a pair of control arms received in a foot slide rail shrinks to lower a foot portion of the body support member and vice versa with respect to a lower head portion and a higher foot portion of the support member.

17. The powered rocking bed of claim 15, wherein the sliding member comprises at least one of a roller and a sliding pin and the like.

18. The powered rocking bed of claim 15, wherein the powered driver is configured in at least one of a horizontal 'pancake' configuration, an upright configuration, an elliptical cam configuration and a circular flywheel configuration.

19. The powered rocking bed of claim 15, wherein the at least one head and one foot slide rails are respectively configured into a vertical sleeve to receive one of a roller and the sliding pin of each control arm in order to transfer the push-pull longitudinal force into an oscillating head-foot vertical force.

20. The powered rocking bed of claim 15, wherein a slide rail comprises a slide rail sleeve disposed proximal at least one of an end and a corner of the powered bed.

* * * * *